US010508366B2

(12) United States Patent
Vanderjeugt et al.

(10) Patent No.: US 10,508,366 B2
(45) Date of Patent: Dec. 17, 2019

(54) JACQUARD MACHINE, FACE-TO-FACE WEAVING MACHINE COMPRISING AT LEAST ONE JACQUARD MACHINE, AND METHOD OF SETTING UP A JACQUARD MACHINE

(71) Applicant: Vandewiele NV, Kortrijk/Marke (BE)

(72) Inventors: Bram Vanderjeugt, Ypres (BE); Frederik De Medts, Ooigem (BE)

(73) Assignee: Vandewiele NV, Kortrijk/Marke (BE)

( * ) Notice: Subject to any disclaimer, the term of this patent is extended or adjusted under 35 U.S.C. 154(b) by 0 days.

(21) Appl. No.: 15/772,556

(22) PCT Filed: Oct. 27, 2016

(86) PCT No.: PCT/EP2016/075988
§ 371 (c)(1),
(2) Date: May 1, 2018

(87) PCT Pub. No.: WO2017/076753
PCT Pub. Date: May 11, 2017

(65) Prior Publication Data

US 2018/0320295 A1 Nov. 8, 2018

(30) Foreign Application Priority Data

Nov. 4, 2015 (EP) ..... 15192876

(51) Int. Cl.
*D03C 3/24* (2006.01)
*D03C 3/26* (2006.01)
(Continued)

(52) U.S. Cl.
CPC ..... *D03C 3/26* (2013.01); *D03C 3/24* (2013.01); *D03D 39/16* (2013.01)

(58) Field of Classification Search
CPC ... D03C 3/12; D03C 3/24; D03C 3/06; D03C 13/00; D03C 19/00; D03C 3/40; D03D 39/08; D03D 39/12; D03D 39/16
See application file for complete search history.

(56) References Cited

U.S. PATENT DOCUMENTS 4,858,654 A * 8/1989 Derudder ..... D03C 3/12 139/59
4,915,138 A * 4/1990 Derudder ..... D03D 39/12 139/40
(Continued)

FOREIGN PATENT DOCUMENTS

CN 102421948 4/2012
DE 19547765 6/1996
(Continued)

OTHER PUBLICATIONS

International Search Report filed in PCT/EP2016/075988 dated Jan. 2, 2017.
European Search Report filed in EP 15192876 dated Apr. 29, 2016.

*Primary Examiner* — Robert H Muromoto, Jr.
(74) *Attorney, Agent, or Firm* — Rankin, Hill & Clark LLP

(57) ABSTRACT

A jacquard machine includes a plurality of yarn moving elements and in association with each yarn moving element a yarn moving mechanism having an output cord connected to the yarn moving element, a plurality of setting bars extending substantially in a first direction corresponding to a weft direction and positioned adjacent to each other substantially in a second direction longitudinal end regions and a cooperation region arranged between the longitudinal end regions for the cooperation with a plurality of yarn moving mechanisms, a plurality of position adjustment bars extending substantially in the second direction, wherein in each one of the two longitudinal end regions of the setting
(Continued)

bars two position adjustment bars are provided adjacent to each other, and a plurality of connecting members for connecting the setting bars to the position adjustment bars, wherein in each longitudinal end region of each setting bar one connecting members is provided such as to be connectable to either one of the two position adjustment bars arranged in a respective one of the longitudinal end regions of the setting bars.

15 Claims, 7 Drawing Sheets

(51) Int. Cl.
*D03D 39/16* (2006.01)
*D03C 3/00* (2006.01)

(56) References Cited

U.S. PATENT DOCUMENTS 5,038,837 A * 8/1991 Palau ..... D03C 3/12 139/455
5,139,052 A * 8/1992 Derudder ..... D03C 3/12 139/21
5,353,846 A * 10/1994 Gheysen ..... D03C 3/12 139/65
5,522,435 A * 6/1996 DeRudder ..... D03C 3/06 139/21
5,540,262 A * 7/1996 Bassi ..... D03C 3/12 139/65
5,678,612 A * 10/1997 Derudder ..... D03C 3/12 139/65
7,077,169 B2 * 7/2006 Bruynoghe ..... D03D 39/08 139/447
7,150,296 B2 * 12/2006 Vanderjeugt ..... D03C 3/12 139/59
7,487,804 B2 * 2/2009 Bruynoghe ..... D03D 39/08 139/116.5
2004/0216797 A1 * 11/2004 Porter ..... D03C 3/24 139/85
2007/0235102 A1 * 10/2007 Bruynoghe ..... D03D 39/08 139/21
2008/0115852 A1 * 5/2008 Debaes ..... D03D 39/16 139/21

FOREIGN PATENT DOCUMENTS

EP 0570947 11/1993
EP 1607501 12/2005
WO 2014076558 5/2014

* cited by examiner

PRIOR ART

JACQUARD MACHINE, FACE-TO-FACE WEAVING MACHINE COMPRISING AT LEAST ONE JACQUARD MACHINE, AND METHOD OF SETTING UP A JACQUARD MACHINE

The present invention refers to a jacquard machine and a face-to-face weaving machine comprising at least one jacquard machine. The invention further refers to a method of setting up a jacquard machine.

From WO 2014/076558 A2, a module providing a yarn moving mechanism for moving one or a plurality of yarn moving elements, for example, heddles, in a jacquard machine is known. Such a known module is shown in FIG. 1. The module 10 providing the yarn moving mechanism 12 has a hoist mechanism 14 with a cord 16 having hooks 18, 20 fixed to its ends. These hooks 18, 20 are provided for the cooperation with two knives 22, 24 which are arranged for a counter-phase movement for selectively moving the associated hooks 18, 20 between an upper position and a lower position. By selecting means, the hooks 18, 20 may be selected, for example, in their upper position, such as to be decoupled from the associated knives 22, 24.

The cord 16 is guided around a first pulley 26. An output cord 28 of the yarn moving mechanism is guided around a second pulley 30. A downwardly extending output end 32 of the output cord 28 is connected to one or a plurality of yarn moving elements, for example, heddles. A connecting end 34 of the output cord 28 is connectable to a setting bar 36 by means of a hook 37 fixed to the connecting end 34. The setting bar 36 extends across a jacquard machine in a first direction which, when being provided in a weaving machine, substantially corresponds to the weft direction. In its two longitudinal end regions, the setting bar 36 is connected to position adjustment bars of the jacquard machine. By adjusting a height position of these position adjustment bars and/or an inclination of these position adjustment bars relative to a second direction which substantially corresponds to a warp direction, a height position of the setting bar 36, i.e. the position in a height direction which is perpendicular with respect to the first and second directions, i.e. the weft direction and the warp direction, can be adjusted.

Due to the cooperation of the hook 37 with the setting bar 36, a basis condition of the yarn moving mechanism 12 can be set. This basis condition, in the shown example, is primarily defined by a predefined positioning of the connecting end 34 of the output cord 28.

It is to be noted that, in a jacquard machine, a plurality of such yarn moving mechanisms are provided such that each yarn moving element can be moved for thereby moving an associated pile warp yarn for forming a shed. For example, in association with each yarn moving element, one such yarn moving mechanism can be provided. Alternatively, one such yarn moving mechanism may be arranged such as to cooperate with a plurality of yarn moving elements. Further, a plurality of setting bars are provided, each setting bar extending in the first direction, i.e. the weft direction, and the setting bars being positioned following each other in the second direction, i.e. the warp direction, such that, for each yarn moving mechanism, there is a setting bar 36 for setting the basis condition thereof. Of course, each setting bar is provided for the cooperation with a plurality of yarn moving mechanisms arranged following each other in a first direction, i.e. the weft direction, and/or arranged immediately adjacent to each other in the warp direction.

It is an object of the present invention to provide a jacquard machine, a face-to-face weaving machine comprising at least one jacquard machine, and a method of setting up a jacquard machine by means of which an enhanced moving behavior of the yarns moved by the yarn moving elements for forming a shed during a weaving process, in particular a face-to-face weaving process in which weft yarns are introduced in at least two different height positions, can be obtained.

According to a first aspect of the present invention, this object is achieved by a jacquard machine, comprising:

- a plurality of yarn moving elements and in association with each yarn moving element a yarn moving mechanism having an output cord connected to the yarn moving element,
- a plurality of setting bars extending substantially in a first direction corresponding to a weft direction and positioned adjacent to each other substantially in a second direction corresponding to a warp direction, each setting bar having two longitudinal end regions and a cooperation region arranged between the longitudinal end regions for the cooperation with a plurality of yarn moving mechanisms, for example, for setting a basis condition of the yarn moving mechanisms cooperating therewith,
- a plurality of position adjustment bars extending substantially in the second direction, wherein in each one of the two longitudinal end regions of the setting bars two position adjustment bars are provided adjacent to each other,
- a plurality of connecting means for connecting the setting bars to the position adjustment bars, wherein in each longitudinal end region of each setting bar one connecting means is provided such as to be connectable to either one of the two position adjustment bars arranged in a respective one of the longitudinal end regions of the setting bars.

In the jacquard machine of the present invention, each one of the setting bars can selectively be connected either to the one or the other one of the two position adjustment bars provided in a respective longitudinal end region of the setting bars allowing the selection of those two position adjustment bars, i.e. a pair of position adjustment bars, to which a respective setting bar has to be connected. Due to this, groups and sub-groups of setting bars may be provided associated with different kinds of pile warp yarns used in a face-to-face weaving process. For example, the pile warp yarns used in a face-to-face weaving process may comprise one kind of pile warp yarns which, when not being used for forming piles, i.e. when being dead piles, are to be incorporated in a top fabric, and an other kind of pile warp yarns which, when not being used for forming piles, i.e. when being used as dead piles, are incorporated in the bottom fabric. Due to the variability of the connection of the setting bars to the position adjustment bars, the position of setting bars associated with those different kinds of pile warp yarns used in a face-to-face weaving process can easily be set differently for those different kinds of pile warp yarns.

For providing a connection between the setting bars and the position adjustment bars, each connecting means may comprise a first connecting member connected or connectable to a setting bar and a second connecting member connected or connectable to a position adjustment bar and connected to at least one first connecting member.

For allowing the connection of the setting means to each one of the two position adjustment bars provided in a respective longitudinal end region of the setting bars, the first connecting member of each one of the connecting means may be shiftable along the setting bar connected thereto. For example, the first connecting member may comprise a receiving opening for shiftably receiving a shifting portion of the setting bar.

For avoiding an undesired movement of a respective first connecting member relative to an associated setting bar, locking means may be provided for locking the first connecting member to the setting bar at its longitudinal end region connected thereto in a first locking position and a second locking position, wherein in the first locking position the connecting means is positioned for connecting to one of the two position adjustment bars and in the second locking position the connecting means is positioned for connecting to the other one of the two position adjustment bars.

For providing a simple construction, at least one second connecting member may be connected to a plurality of first connecting members.

For allowing cooperation of all the position adjustment bars with all the setting bars provided in the jacquard machine, preferably each position adjustment bar extends in a second direction such as to be connectable to all setting bars, and/or each setting bar extends in the first direction substantially over all position adjustment bars such as to be connectable to each one of the position adjustment bars.

The position adjustment bars may be supported by a supporting frame of the jacquard machine.

For adjusting the height position of the setting bars connected to the position adjustment bars, a height position of the position adjustment bars in a height direction perpendicular to the first and second directions and/or an inclination of the position adjustment bars relative to a second direction may be variable.

According to a second aspect of the present invention, the above object is achieved by a face-to-face weaving machine, comprising at least one jacquard machine, preferably according to the present invention, wherein a plurality of pile warp yarns are provided extending in a warp direction and positioned adjacent to each other in a weft direction, each pile warp yarn having a yarn moving element of the at least one jacquard machine associated therewith for moving the pile warp yarns for forming a shed, wherein a first group of yarn moving elements of the at least one jacquard machine is associated with pile warp yarns to be incorporated in a top fabric when being dead piles and a second group of yarn moving elements of the at least one jacquard machine is associated with pile warp yarns to be incorporated in a bottom fabric when being dead piles, wherein the first group of yarn moving elements comprises a plurality of first sub-groups of yarn moving elements and the second group of yarn moving elements comprises a plurality of second sub-groups of yarn moving elements, wherein the first and second sub-groups of yarn moving elements are arranged alternately in the warp direction.

In the face-to-face weaving machine of the present invention, the yarn moving elements associated with one particular kind of pile warp yarns are spread over an increased length in the warp direction as compared to an arrangement in which all the yarn moving elements of the first group are provided in one area adjacent to an other area where all the yarn moving elements of the second group are provided. Due to this spreading of the yarn moving elements of each one of the two groups over an increased length in the warp direction, the pile warp yarns can be easily moved in the height direction by means of the yarn moving elements for forming a shed with a reduced frictional interaction of immediately adjacent pile warp yarns, in particular with those layers of pile warp yarns incorporated into the fabrics as dead piles.

According to an advantageous aspect of the present invention, at least one, preferably each jacquard machine may comprise a plurality of setting bars extending substantially in the weft direction and positioned adjacent to each other substantially in the warp direction, each setting bar having two longitudinal end regions and a cooperation region arranged between the longitudinal end regions for the cooperation with a plurality of yarn moving mechanisms, for example, for setting a basis condition of the yarn moving mechanisms cooperating therewith, each yarn moving mechanism having an output cord connected to at least one yarn moving element, wherein a first group of setting bars is provided for the cooperation with yarn moving mechanisms connected to yarn moving elements of the first group of yarn moving elements and a second group of setting bars is provided for the cooperation with yarn moving mechanisms connected to yarn moving elements of the second group of yarn moving elements, wherein the first group of setting bars comprises a plurality of first sub-groups of setting bars, each first sub-group of setting bars being associated with one first sub-group of yarn moving elements, and comprises a plurality of second sub-groups of setting bars, each second sub-group of setting bars being associated with one second sub-group of yarn moving elements, wherein the first and second sub-groups of setting bars are arranged alternately in the warp direction. The provision of such sub-groups of setting bars in association with sub-groups of yarn moving elements allows the spreading of the yarn moving elements of each one of the two groups over an increased length in the warp direction while still providing the setting bars associated with the yarn moving elements of the two groups and the yarn moving mechanisms thereof in the desired height position for thereby defining the correct basis condition of each one of the yarn moving mechanisms.

For allowing the adjustment of the height position of the setting bars, at least one, preferably each jacquard machine may comprise a plurality of position adjustment bars extending substantially in the warp direction, wherein in each longitudinal end region of the setting bars two position adjustment bars may be provided adjacent to each other, wherein the setting bars of the first sub-group of setting bars by means of connecting means are connected to the position adjustment bars of a first pair of position adjustment bars comprising one of the position adjustment bars positioned in a first one of the longitudinal end regions of the setting bars and one of the position adjustment bars positioned in a second one of the longitudinal end regions of the setting bars, and wherein the setting bars of the second sub-group of setting bars by means of connecting means are connected to the position adjustment bars of a second pair of position adjustment bars comprising the other one of the position adjustment bars positioned in the first longitudinal end region of the setting bars and the other one of the position adjustment bars positioned in the second longitudinal end region of the setting bars.

For example, the first pair of position adjustment bars and the second pair of position adjustment bars may be inclined at different angles with respect to the warp direction.

According to a very advantageous setup of a face-to-face weaving machine, each group of yarn moving elements may be associated with pile warp yarns having the same color.

According to a further aspect the invention refers to a method of setting up a jacquard machine according to the present invention, preferably in a face-to-face weaving machine as described before, comprising the steps of:

a) defining first sub-groups of yarn moving elements provided for the cooperation with pile warp yarns to be incorporated in a top fabric of a face-to-face fabric as dead piles and defining second sub-groups of yarn moving elements provided for the cooperation with pile warp yarns to be incorporated in a bottom fabric of the face-to-face fabric as dead piles, such that there is an alternating arrangement of the first and second sub-groups in a direction substantially corresponding to a warp direction, b) in association with the alternating arrangement of the first and second sub-groups of yarn moving elements providing an alternating arrangement of first and second sub-groups of setting bars by connecting the setting bars of the first sub-groups of setting bars in each one of their two longitudinal end regions to one of the two position adjustment bars provided in each one of the two longitudinal end regions of the setting bars and connecting the setting bars of the second sub-groups of setting bars in each one of their two longitudinal end regions to the other one of the two position adjustment bars provided in each one of the two longitudinal end regions of the setting bars, wherein at least one, preferably each sub-group of setting bars comprises a plurality of setting bars positioned adjacent to each other in a direction substantially corresponding to the warp direction, c) connecting yarn moving mechanisms associated with the yarn moving elements of the first sub-groups of yarn moving elements to the setting bars of the first sub-groups of setting bars and connecting yarn moving mechanisms associated with the yarn moving elements of the second sub-groups of yarn moving elements to the setting bars of the second sub-groups of setting bars.

In the method of the present invention after having decided which ones of the yarn moving elements will be provided for the cooperation with the pile warp yarns to be incorporated in the top fabric as dead piles and which one of the yarn moving elements will be provided for the cooperation with the pile warp yarns to be incorporated in the bottom fabric as dead piles and thereby having associated the yarn moving elements with the first and second sub-groups of yarn moving elements, a corresponding association of the setting bars of one or a plurality of jacquard machines to the first and second sub-groups of setting bars by connecting these setting bars to respective ones of the two position adjustment bars provided in each one of the longitudinal end regions of the setting bars is carried out. If this setting up of one or a plurality of jacquard machines starts out from an other setup, in which the yarn moving elements are associated with respective groups or sub-groups of yarn moving elements, respectively, that differ from the ones of the new setup, and in which therefore there is an other association of setting bars with respective groups and sub-groups, respectively, of setting bars, this may first of all require the disconnection of at least some of the setting bars from position adjustment bars to which they have been connected in the previous setup for then connecting these setting bars to the position adjustment bars in such a manner, that the alternating arrangement of first and second sub-groups of setting bars of the new setup is obtained.

In the following, the present invention will be explained with reference to the drawings, wherein.

Figure 1:
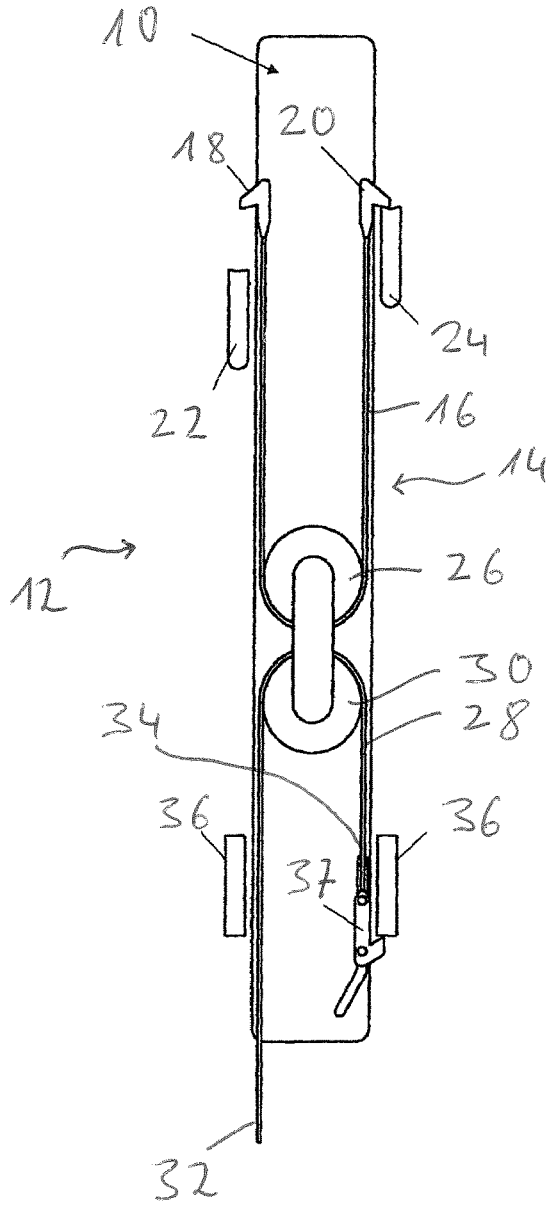
FIG. 1 shows a yarn moving mechanism known in the prior art.
Figure 2:
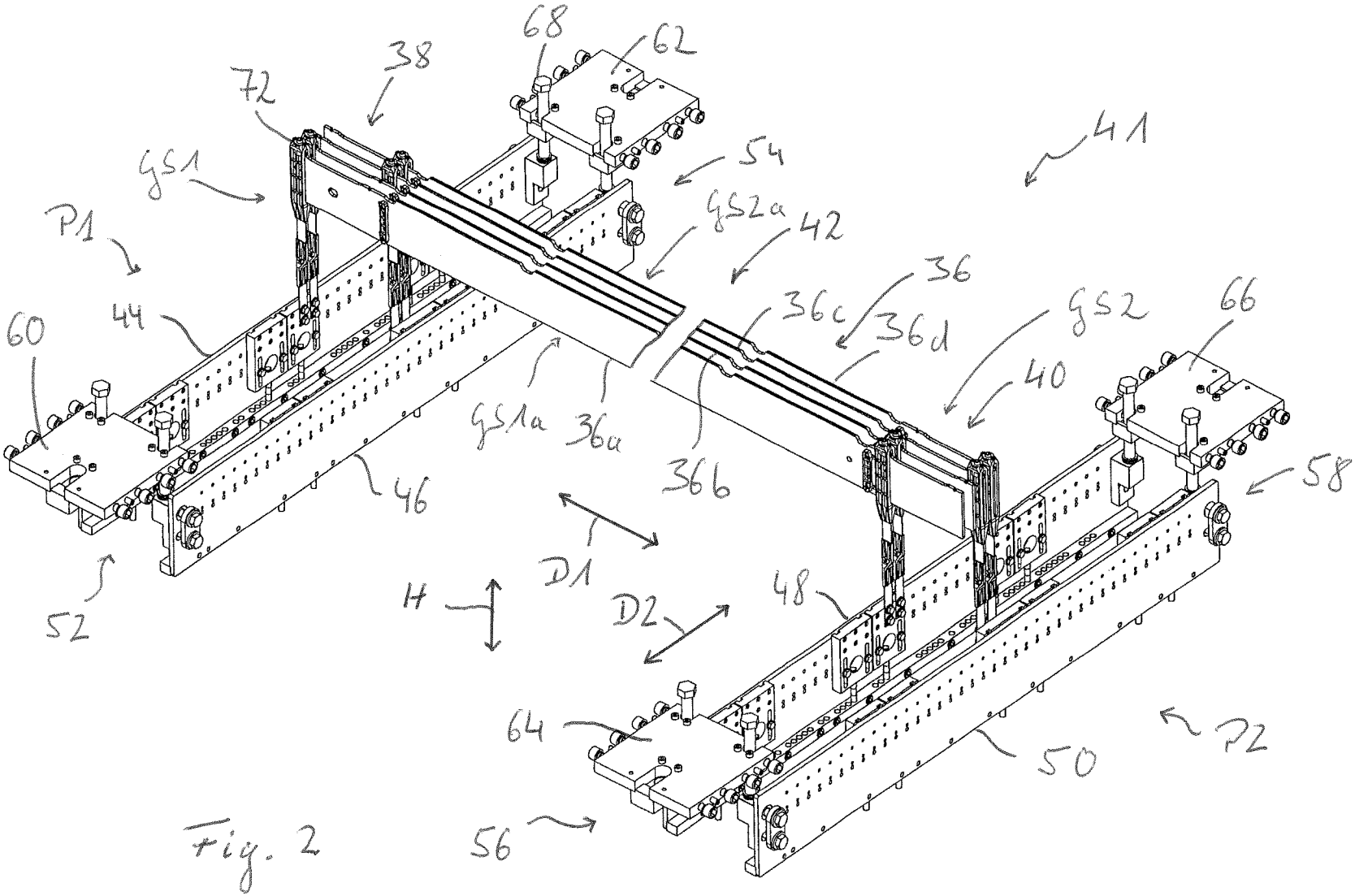
FIG. 2 shows setting bars of a jacquard machine connected to position adjustment bars.
Figure 3:
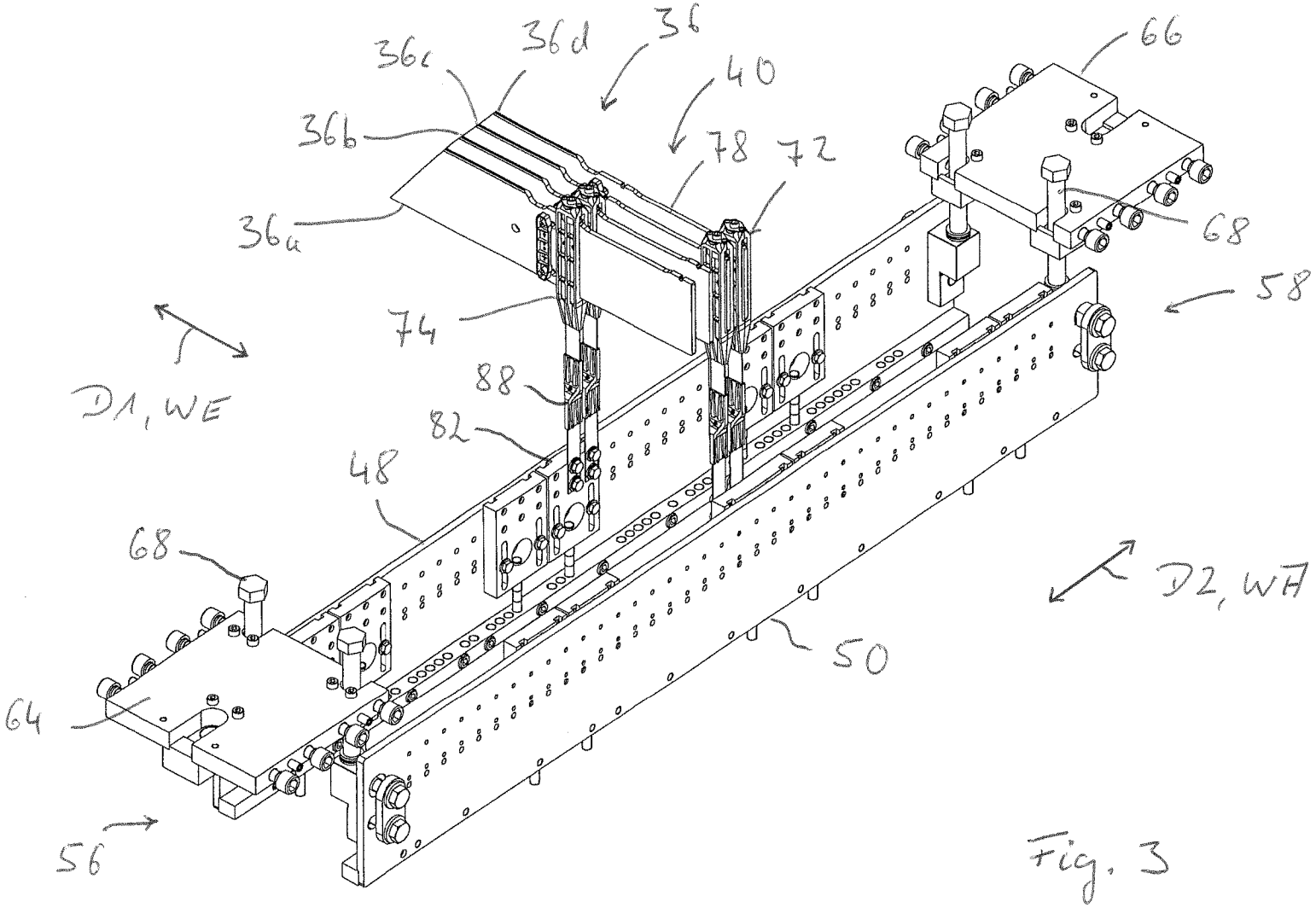
FIG. 3 shows an enlarged detail of FIG. 2.
Figure 4:
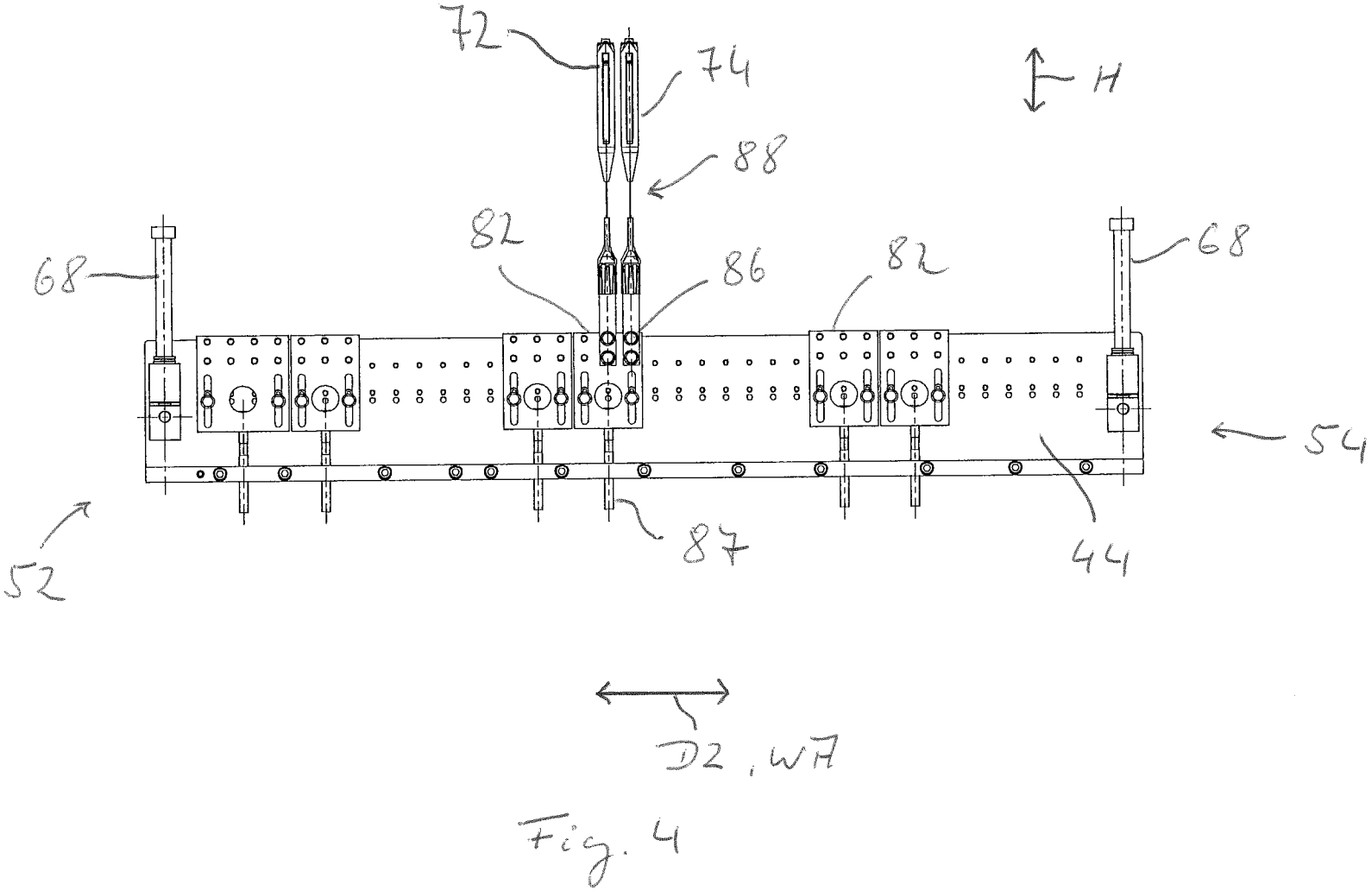
FIG. 4 shows a side view of a position adjustment bar having two setting bars connected thereto by means of connecting means.

FIG. 2 shows the essential portion of a jacquard machine generally denoted by 41. It is to be noted that the not-shown portion of the jacquard machine 41 may be constructed in a conventional manner, for example, as known from WO 2014/076558 A2. Further, the yarn moving mechanisms for moving the yarn moving elements, for example, the heddles, of a jacquard machine may be constructed such as shown in WO 2014/076558 A2 and in FIG. 1, respectively, and may comprise tackle arrangements for allowing three or four height positions of the yarn moving elements connected thereto.

The jacquard machine 41 of the present invention comprises a plurality of setting bars generally denoted by 36. In FIG. 2, four setting bars 36*a*, 36*b*, 36*c*, 36*d* are shown. All these setting bars 36 extend in a first direction D1, which, when being provided in a weaving machine, substantially corresponds to the weft direction WE. The setting bars 36 are arranged parallel to each other side by side in a second direction D2, which, when being installed in a weaving machine, substantially corresponds to the warp direction WA. Each of the setting bars 36 has two longitudinal end regions 38, 40 and has a cooperation region 42 between these longitudinal end regions 38, 40. In the cooperation region 42, the setting bars 36 are positioned for the cooperation with the yarn moving mechanisms, for example, in a manner as shown in FIG. 1.

In each one of the two end regions 38, 40 of the plate-shaped setting bars 36, two position adjustment bars 44, 46 and 48, 50 are provided. The plate-shaped position adjustment bars 44, 46, 48, 50 are arranged parallel to each other such as to extend substantially in the second direction D2. In their longitudinal end regions 52, 54, 56, 58, the position adjustment bars 44, 46, 48, 50 are supported by a supporting frame of the jacquard machine 40, which, in FIG. 2, is represented by the four supporting plates 60, 62, 64, 66. Each position adjustment bar 44, 46, 48, 50 is supported by the respective supporting plate 60, 62, 64, 66 by means of respective supporting screws 68 such that the height position of each longitudinal end region 52, 54, 56, 58 of the position adjustment bars 44, 46, 48, 50 in a height direction H, i.e. a direction which is substantially perpendicular to the first and second directions D1 and D2, can be adjusted. By adjusting the height position of the position adjustment bars 44, 46, 48, 50 in their longitudinal end regions 52, 54, 56, 58, the height position of the entire position adjustment bars 44, 46, 48, 50 as well as their inclination relative to the second direction D2 can be adjusted. It is to be noted that the height position as well as the inclination can be individually adjusted for each one of the four position adjustment bars 44, 46, 48, 50.

Each one of the setting bars 36 extends in the first direction D1 over all position adjustment bars 44, 46, 48, 50 and is connected to two of the position adjustment bars 44, 46, 48, 50 by means of respective connecting means 72. In each longitudinal end region 38, 40 of each setting bar 36, one such connecting means 72 is provided.

Figure 5:
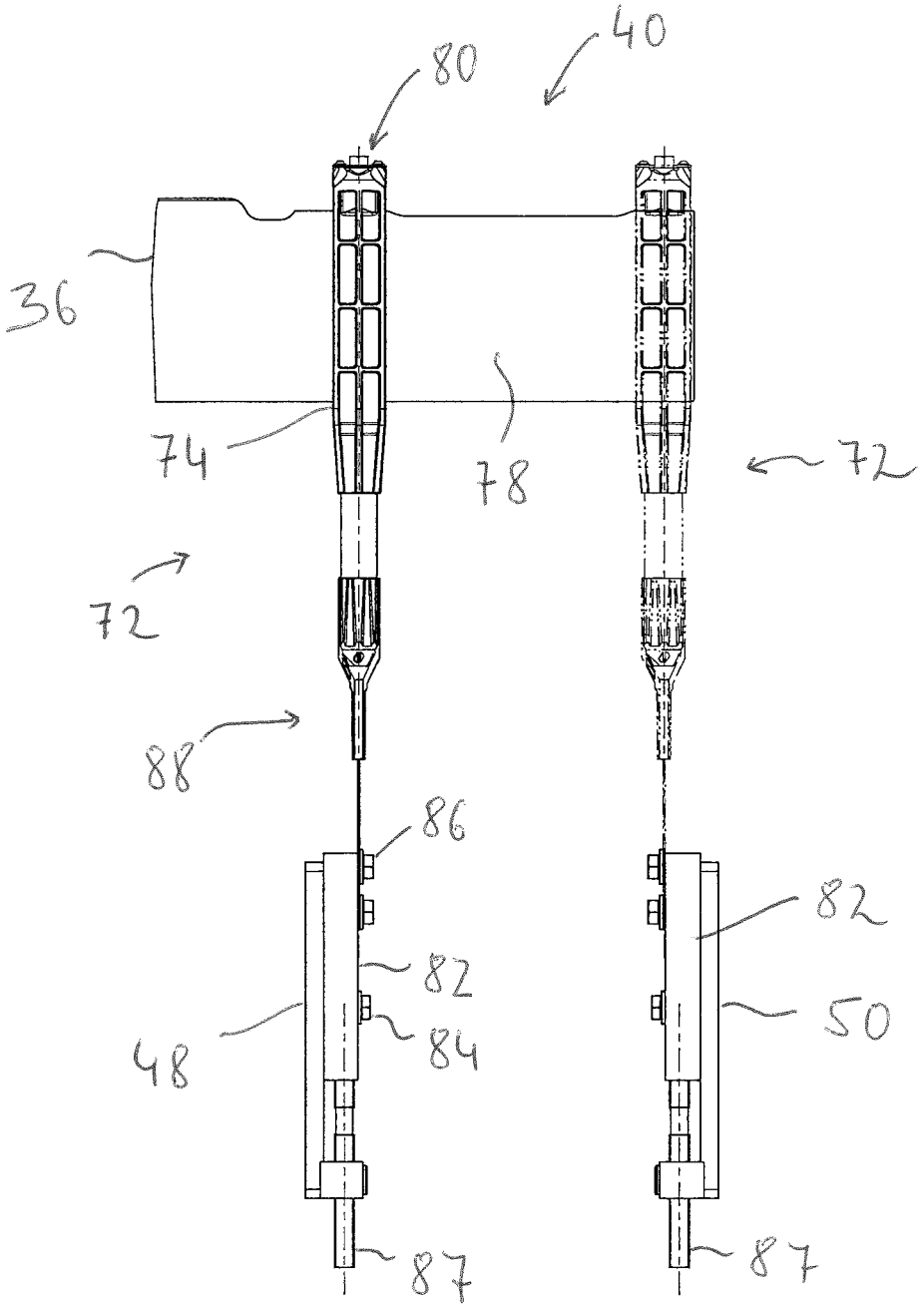
FIG. 5 shows a longitudinal end region of a setting bar connected to a position adjustment bar by means of a connecting means and alternatively connected to another position adjustment bar by means of the same connecting means.
Figure 6:
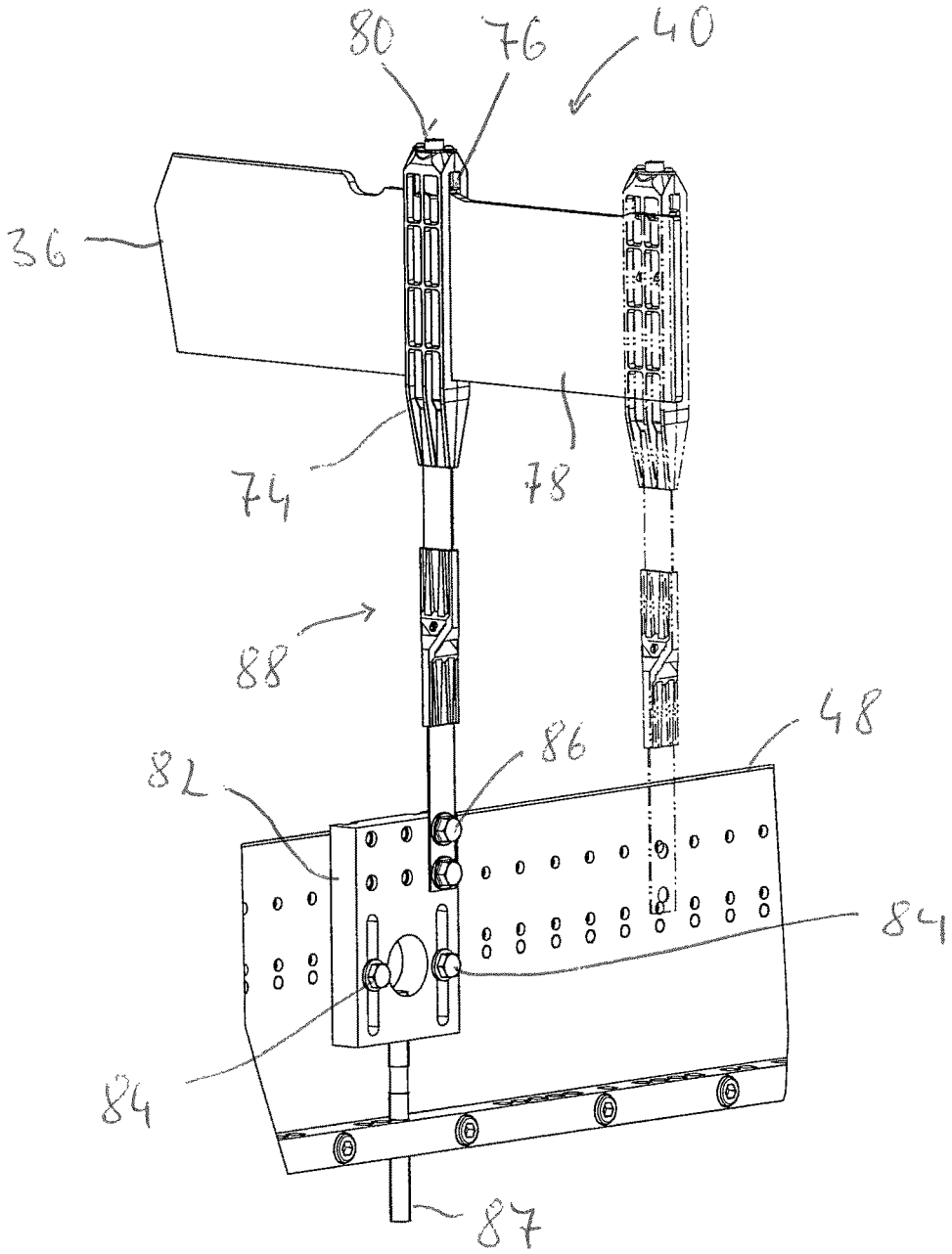
FIG. 6 shows the longitudinal end region of a setting bar and the position adjustment bar of FIG. 5 in a perspective view.

Each connecting means 72 comprises a first connecting member 74 connected to a respective longitudinal end region 38, 40 of the associated setting bar 36 such as to be shiftable in the longitudinal direction of the setting bar 36 corresponding to the first direction D1. As can be seen in the FIG. 6, the first connecting members 74 have a slot-shaped receiving opening 76 adapted to the plate-shaped cross-section of the longitudinal end regions 38, 40 of the setting bars 36. In the shifting portion 78 of the setting bars 36 provided in each one of the longitudinal end regions 38, 40 thereof, the first connecting members 74 can be locked to the setting bar 36 by means of locking means 80. For example, these locking means 80 may comprise a pretensioned locking member in each first connecting member 74 and locking grooves in the setting bar 36 receiving this pretensioned locking member when the first connecting member 74 is in one of the two obtainable locking positions. In a first one of these locking positions, the first connecting members 74 are locked to the associated setting bars 36 at their outermost end, which, in FIGS. 5 and 6, is shown by means of a first connecting member 74 shown in broken lines. By shifting the first connecting members 74 towards the cooperation region 42, the first connecting members 74 can be brought to their second locking position shown in FIGS. 5 and 6 by means of a first connecting member 74 shown in full lines.

The connecting means 72 comprise plate-shaped second connecting members 82 which, by means of fastening screws 84, can be fixed to the position adjustment bars 44, 46, 48, 50. By means of a height position adjustment screw 87, the height position of a respective second connecting member 82 relative to an associated position adjustment bar 44, 46, 48, 50 can be selected. After having reached the desired height position, the second connecting member 82 can be fixed to the associated position adjustment bar 44, 46, 48, 50 by means of the fastening screws 84. As can be seen in the figures, the second connecting members 82 may be arranged such as to be connected to a plurality of first connecting members 74 by means of respective fastening screws 86. In the example shown in FIG. 6, three first connecting members 74 associated with three immediately adjacent setting bars 36 can be connected to the same second connecting member 82. For connecting the first connecting members 74 to the second connecting members 82, the first connecting members 74 may comprise a flexible connecting portion 88.

By selecting the relative positioning of the connecting means 72 relative to the associated setting bars 36, the position adjustment bars 44, 46, 48, 50, to which a respective one of the setting bars 36 is connected, can be selected. For example, in FIG. 2, the connecting means 72 provided in the longitudinal end region 38 of the connecting bar 36*a* is in its first locking position such that this connecting means 72 can be connected to the position adjustment bar 44. The connecting means 72 provided in the other longitudinal end region 40 of this setting bar 36 is in its second locking position such that it can be connected to the position adjustment bar 48. The same arrangement has been selected in association with the setting bar 36*b*. In association with setting bars 36*c* and 36*d*, the connecting means 72 provided at the longitudinal end regions 38 thereof are in their second locking position and therefore can be connected to the position adjustment bar 46. The connecting means 72 provided at the longitudinal end region 40 of the setting bars 36*c* and 36*d* are in their first locking position and therefore can be connected to the position adjustment bar 50.

Due to this arrangement, the position adjustment bars 44 and 48 provide a first pair P1 of position adjustment bars to which the setting bars of a first group GS1 of setting bars are connected, while the position adjustment bars 46, 50 provide a second pair P2 of position adjustment bars to which the setting bars of a second group GS2 of setting bars are connected. Due to the fact that the height position as well as the inclination of all the position adjustment bars 44, 46, 48, 50 can be individually adjusted, the height position of the setting bars of the first group GS1, i.e. the setting bars connected to the position adjustment bars 44, 48, and the height position of the setting bars of the second group GS2, i.e. the setting bars connected to the position adjustment bars 46, 50 can be set independently of each other by adjusting the height position and/or the angle of inclination of the two position adjustment bars 44, 48 of the first pair P1 differently from the height position and/or the angle of inclination of the position adjustment bars 46, 50 of the second pair P2.

For allowing this selection of the position adjustment bars to which a respective setting bar is connected by means of the connecting means 72, all the setting bars 36 extend in the first direction substantially over all the position adjustment bars 44, 46, 48, 50. This means that the locking means 72, positioned in their first locking position, i.e. positioned at or near the outermost end of a respective setting bar 36, are positioned such that they can be connected to one of the two outermost adjustment bars 44 or 50. This does not require that the setting bars 36, in their respective longitudinal end regions 38, 40, extend beyond the two outermost adjustment bars 44, 50 in the first direction, but only requires such a length of the setting bars 36 that the connecting means 72, positioned in the first locking position, can be connected to one of the outermost adjustment bars 44, 50.

It is to be noted that such a jacquard machine may comprise only such setting bars 36 which can selectively be connected to either one of the two position adjustment bars arranged at the respective longitudinal end regions of the setting bars 36. However, there may be additional setting bars, not shown in the figures, which are arranged such as to be only connected or connectable to the one or the other one of the two position adjustment bars positioned at respective longitudinal end region of these setting bars.

Figure 7:
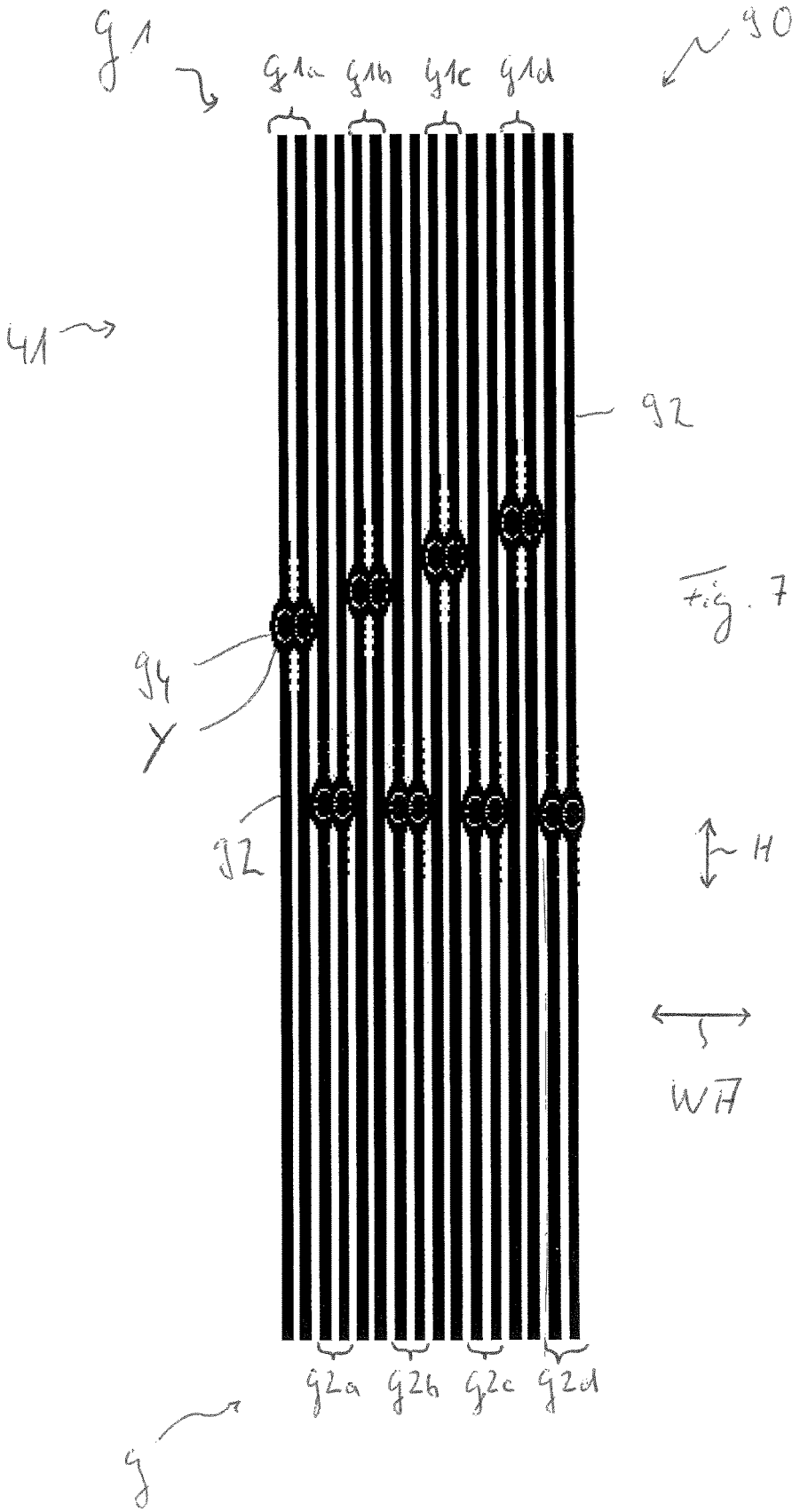
FIG. 7 shows two groups of yarn moving elements provided in a jacquard machine divided into sub-groups of yarn moving elements.

In the following, with reference to FIG. 7, a setup of the yarn moving elements 92, i.e. the heddles, provided in a weaving machine generally denoted by 90 will be explained. In FIG. 7 the yarn moving elements are shown in a position provided during one particular pick, i.e. one weft insertion cycle, in which a shed is formed for introducing a weft thread. During a subsequent weft insertion cycle there will be an other positioning of the yarn moving elements.

The yarn moving elements 92 are associated with groups G1 and G2. The first group G1 is subdivided into a plurality of sub-groups G1*a*, G1*b*, G1*c* and G1*d*. The second group G2 is subdivided into sub-groups G2*a*, G2*b*, G2*c* and G2*d*. Each one of these sub-groups G1*a*, G1*b*, G1*c*, G1*d*, G2*a*, G2*b*, G2*c*, G2*d* of yarn moving elements (92) may comprise a plurality of yarn moving elements (92) offset with respect to each other in the warp direction WA and in the weft direction WE. The yarn moving elements 92 of the first group G1, for example, may be associated with pile warp yarns provided in a weaving machine extending in a warp direction WA and adjacent to each other in a weft direction WE, which is perpendicular to the drawing plane of FIG. 7, which pile warp yarns are to be incorporated into a top fabric of the two fabrics to be woven by the face-to-face weaving machine 90 in a face-to-face weaving process when not being used for forming piles, i.e. when being dead piles. The pile warp yarns associated with the yarn moving elements 92 of the second group G2, in this example, may be pile warp yarns which, when not being used for forming piles, are to be incorporated into the bottom fabric of the two fabrics which are simultaneously woven in the face-to-face weaving process. It is to be noted that a pile warp yarn Y associated with a respective one of the yarn moving elements 92 may be guided through a respective eyelet 94 of this yarn moving element such that, by means of a movement of the yarn moving element 92 in the height direction H, the associated pile warp yarn can be moved in the height direction for forming the shed.

As can be seen in FIG. 7, due to the provision of the sub-groups G1*a*, G1*b*, G1*c*, G1*d* of the first group G1, the locations at which the associated pile warp yarns cooperate with the yarn moving elements of this group G1 are spread over an extended area in the warp direction WA. The same is true for the locations at which the pile warp yarns associated with the yarn moving elements of the second group G2 interact with their associated yarn moving elements. Due to this spreading of the locations of interaction, the frictional interaction of immediately adjacent pile warp yarns which, preferably, are associated with different sub-groups can be reduced such that an easier movement of the pile warp yarns in the height direction when forming the shed with a reduced frictional interaction of immediately adjacent pile warp yarns can be obtained.

The arrangement shown in FIG. 7 having four sub-groups of each one of the two groups G1 and G2, for example, may be used in a face-to-face weaving machine and a face-to-face weaving process in which pile warp yarns of eight different colors are used. For example, a pile warp yarn system comprising all the pile warp yarns extending through one dent may comprise eight pile warp yarns of different color. Four of these differently colored pile warp yarns are to be incorporated in the top fabric when being dead piles, while the other four differently colored pile warp yarns of each pile warp yarn system are to be incorporated in the bottom fabric when being dead piles. Each one of the sub-groups G1*a*, G1*b*, G1*c*, G1*d*, G2*a*, G2*b*, G2*c*, and G2*d* is provided for the interaction with pile warp yarns of one color. For example, the yarn moving elements 92 of the first sub-group G1*a* are provided for moving all the pile warp yarns of all the pile warp yarn systems having a first color, while the yarn moving elements 92 of the second sub-group G2*a* are provided for moving the pile warp yarns of all pile warp yarn systems having a second color, and so on. In such an arrangement, the number of yarn moving elements 92 in each one of the eight sub-groups corresponds to the number of pile warp yarn systems and the number of dents through which such pile warp yarn systems extend, respectively. Of course, there may be another association of pile warp yarns with the yarn moving elements 92 of the various sub-groups and, of course, there may be another number of sub-groups and another number of yarn moving elements in each one of the sub-groups. This will for example depend on the number of different colors used in a face-to-face weaving procedure and on the way in which the differently colored pile warp yarns will be associated with the top fabric and the bottom fabric.

In association with the sub-groups G1*a*, G1*b*, G1*c*, G1*d*, G2*a*, G2*b*, G2*c*, G2*d* of yarn moving elements 92, the setting bars 36 may be provided in corresponding sub-groups of setting bars. There may be a corresponding alternating arrangement of first sub-groups GS1*a* of setting bars and second sub-groups GS2*a* of setting bars in the second direction D2 corresponding to the warp direction. For example, the setting bars 36*a*, 36*b* may be the setting bars of one first sub-group GS1*a* of the first group GS1 of setting bars, while the setting bars 36*c*, 36*d* may be the setting bars of a second sub-group GS2*a* of the second group GS2 of setting bars. In association with the alternating arrangement of the first and second sub-groups of the yarn moving elements 92, the first and second sub-groups of setting bars may be arranged in such an alternating manner. Due to the fact that all the setting bars of all first sub-groups will be connected to the same pair of position adjustment bars and all the setting bars of all second sub-groups of connecting bars will be connected to the other pair of position adjustment bars, the height positions of the setting bars of the first sub-groups of setting bars can be adjusted independently of the height positions of the setting bars of all the second sub-groups of setting bars, such that the inclined arrangement of the eyelets 94 of the yarn moving elements associated with the first group G1, as can be seen in FIG. 7, as well as another inclination of the immediately adjacent eyelets of the yarn moving elements of the second group G2 may be obtained by providing a corresponding adjustment of the position adjustment bars of the two pairs of position adjustment bars.

It is to be noted that the jacquard machine shown in FIGS. 2 to 6 comprising all the setting bars and the position adjustment bars as well as the setting of yarn moving elements shown in FIG. 7 may be applied in a face-to-face weaving machine having two rapiers, i.e. two gripper mechanisms working at two different levels in the height direction, which requires the provision of three height positions of the yarn moving elements. Of course, the jacquard machine and the setting of the yarn moving elements may also be used in a face-to-face weaving machine having three rapiers, i.e. three gripper mechanisms working at three different height levels in the height direction, which requires the provision of four height positions of the yarn moving elements.

The invention claimed is:

1. Face-to-face weaving machine, comprising at least one jacquard machine, wherein a plurality of pile warp yarns are provided extending in a warp direction and positioned adjacent to each other in a weft direction, each pile warp yarn having a yarn moving element of the at least one jacquard machine associated therewith for moving the pile warp yarns for forming a shed, wherein a first group of yarn moving elements of the at least one jacquard machine is associated with pile warp yarns to be incorporated in a top fabric when being dead piles and a second group of yarn moving elements of the at least one jacquard machine is associated with pile warp yarns to be incorporated in a bottom fabric when being dead piles, wherein the first group of yarn moving elements comprises a plurality of first sub-groups of yarn moving elements and the second group of yarn moving elements comprises a plurality of second sub-groups of yarn moving elements, wherein the first and second sub-groups of yarn moving elements are arranged alternately in the warp direction.

2. The face-to-face weaving machine according to claim 1, wherein the at least one jacquard machine comprises a plurality of setting bars extending substantially in the weft direction and positioned adjacent to each other substantially in the warp direction, each setting bar having two longitudinal end regions and a cooperation region arranged between the longitudinal end regions for the cooperation with a plurality of yarn moving mechanisms, each yarn moving mechanism having an output cord connected to at least one yarn moving element, wherein a first group of setting bars is provided for the cooperation with yarn moving mechanisms connected to yarn moving elements of the first group of yarn moving elements and a second group of setting bars is provided for the cooperation with yarn moving mechanisms connected to yarn moving elements of the second group of yarn moving elements wherein the first group of setting bars comprises a plurality of first sub-groups of setting bars, each first sub-group of setting bars being associated with one first sub-group of yarn moving elements, and comprises a plurality of second sub-groups of setting bars, each second sub-group of setting bars being associated with one second sub-group of yarn moving elements, wherein the first and second sub-groups of setting bars are arranged alternately in the warp direction.

3. The face-to-face weaving machine according to claim 2, wherein the at least one, jacquard machine comprises a plurality of position adjustment bars extending substantially in the warp direction, wherein in each longitudinal end region of the setting bars two position adjustment bars are provided adjacent to each other, wherein the setting bars of the first sub-group of setting bars by means of connecting means are connected to the position adjustment bars of a first pair of position adjustment bars comprising one of the position adjustment bars positioned in a first one of the longitudinal end regions of the setting bars and one of the position adjustment bars positioned in a second one of the longitudinal end regions of the setting bars, and wherein the setting bars of the second sub-group of setting bars by means of connecting means are connected to the position adjustment bars of a second pair of position adjustment bars comprising the other one of the position adjustment bars positioned in the first longitudinal end region of the setting bars and the other one of the position adjustment bars positioned in the second longitudinal end region of the setting bars.

4. The face-to-face weaving machine according to claim 3, wherein the first pair of position adjustment bars and the second pair of position adjustment bars are inclined at different angles with respect to the warp direction.

5. The face-to-face weaving machine according to claim 1, wherein each group of yarn moving elements is associated with pile warp yarns having the same color.

6. Jacquard machine, comprising:

a plurality of yarn moving elements and in association with each yarn moving element a yarn moving mechanism having an output cord connected to the yarn moving element, a plurality of setting bars extending substantially in a first direction corresponding to a weft direction and positioned adjacent to each other substantially in a second direction corresponding to a warp direction, each setting bar having two longitudinal end regions and a cooperation region arranged between the longitudinal end regions for the cooperation with a plurality of yarn moving mechanisms, a plurality of position adjustment bars extending substantially in the second direction, wherein in each one of the two longitudinal end regions of the setting bars two position adjustment bars are provided adjacent to each other, a plurality of connecting means for connecting the setting bars to the position adjustment bars, wherein in each longitudinal end region of each setting bar one connecting means is provided such as to be connectable to either one of the two position adjustment bars arranged in a respective one of the longitudinal end regions of the setting bars.

7. The jacquard machine according to claim 6, wherein each connecting means comprises a first connecting member connected or connectable to a setting bar and a second connecting member connected or connectable to a position adjustment bar and connected to at least one first connecting member.

8. The jacquard machine according to claim 7, wherein the first connecting member is shiftable along the setting bar connected thereto.

9. The jacquard machine according to claim 8, wherein the first connecting member comprises a receiving opening for shiftably receiving a shifting portion of the setting bar.

10. The jacquard machine according to claim 7, wherein locking means are provided for locking the first connecting member to the setting bar at its longitudinal end region connected thereto in a first locking position and a second locking position, wherein in the first locking position the connecting means is positioned for connecting to one of the two position adjustment bars and in the second locking position the connecting means is positioned for connecting to the other one of the two position adjustment bars.

11. The jacquard machine according to claim 7, wherein at least one second connecting member is connected to a plurality of first connecting members.

12. The jacquard machine according to claim 6, wherein each position adjustment bar is extended in the second direction such as to be connectable to all setting bars and/or wherein each setting bar extends in the first direction substantially over all position adjustment bars such as to be connectable to each one of the position adjustment bars.

13. The jacquard machine according to claim 6, wherein the position adjustment bars are supported by a supporting frame of the jacquard machine, and/or wherein a height position of the position adjustment bars in a height direction perpendicular to the first and second directions and/or an inclination of the position adjustment bars relative to the second direction is variable.

14. Method of setting up a jacquard machine, comprising:

a) defining first sub-groups of yarn moving elements provided for the cooperation with pile warp yarns to be incorporated in a top fabric of a face-to-face fabric as dead piles and defining second sub-groups of yarn moving elements provided for the cooperation with pile warp yarns to be incorporated in a bottom fabric of the face-to-face fabric as dead piles, such that there is an alternating arrangement of the first and second sub-groups in a direction substantially corresponding to a warp direction, b) in association with the alternating arrangement of the first and second sub-groups of yarn moving elements providing an alternating arrangement of first and second sub-groups of setting bars by connecting the setting bars of the first sub-groups of setting bars in each one of their two longitudinal end regions to one of the two position adjustment bars provided in each one of the two longitudinal end regions of the setting bars and connecting the setting bars of the second sub-groups of setting bars in each one of their two longitudinal end regions to the other one of the two position adjustment bars provided in each one of the two longitudinal end regions of the setting bars wherein at least one sub-group of setting bars comprises a plurality of setting bars positioned adjacent to each other in a direction substantially corresponding to the warp direction, c) connecting yarn moving mechanisms associated with the yarn moving elements of the first sub-groups of yarn moving elements to the setting bars of first sub-groups of setting bars and connecting yarn moving mechanisms associated with the yarn moving elements of the second sub-groups of yarn moving elements to the setting bars of the second sub-groups of setting bars.

15. The face-to-face weaving machine according to claim 1, comprising a plurality of yarn moving elements and in association with each yarn moving element a yarn moving mechanism having an output cord connected to the yarn moving element, a plurality of setting bars extending substantially in a first direction corresponding to a weft direction and positioned adjacent to each other substantially in a second direction corresponding to a warp direction, each setting bar having two longitudinal end regions and a cooperation region arranged between the longitudinal end regions for the cooperation with a plurality of yarn moving mechanisms, a plurality of position adjustment bars extending substantially in the second direction, wherein in each one of the two longitudinal end regions of the setting bars two position adjustment bars are provided adjacent to each other, a plurality of connecting means for connecting the setting bars to the position adjustment bars, wherein in each longitudinal end region of each setting bar one connecting means is provided such as to be connectable to either one of the two position adjustment bars arranged in a respective one of the longitudinal end regions of the setting bars.

* * * * *